US005495804A

United States Patent [19]

Stellberger et al.

[11] Patent Number: 5,495,804

[45] Date of Patent: Mar. 5, 1996

[54] DEVICE FOR FASTENING A FLEXBILE PRINTING PLATE ON A PLATE CYLINDER OF A ROTARY PRINTING PRESS

[75] Inventors: Rudi Stellberger, Kronau; Uwe Kleinschmidt, Östringen; Hans-Jürgen Kusch, Neckargemund, all of Germany

[73] Assignee: Heidelberger Druckmaschinen AG, Heidelberg, Germany

[21] Appl. No.: 383,077

[22] Filed: Feb. 3, 1995

[30] Foreign Application Priority Data

Feb. 3, 1994 [DE] Germany ..... 94 01 760.3

[51] Int. Cl.[6] ..... B41F 27/06

[52] U.S. Cl. ..... 101/415.1; 101/382.1

[58] Field of Search ..... 400/415.1, 378, 400/382.1, 383, 375, 368

[56] References Cited

U.S. PATENT DOCUMENTS

| | | | |
|---|---|---|---|
| 2,822,754 | 2/1958 | Huck | 101/415.1 |
| 3,793,948 | 2/1974 | Hugonnnier | 101/375 |
| 4,938,134 | 7/1990 | Dörsam et al. | 101/415.1 |
| 5,142,305 | 8/1992 | Maslanka et al. | 101/415.1 |
| 5,181,469 | 1/1993 | Merkel et al. | 101/415.1 |
| 5,184,554 | 2/1993 | Merkel et al. | 101/415.1 |
| 5,295,435 | 3/1994 | Fuchi | 101/378 |
| 5,325,778 | 7/1994 | Hartung et al. | 101/378 |
| 5,367,954 | 11/1994 | Becker | 101/378 |

FOREIGN PATENT DOCUMENTS

| | | | |
|---|---|---|---|
| 0563729 | 9/1958 | Canada | 101/415.1 |
| 0444219 | 9/1991 | European Pat. Off. . | |
| 1248062 | 8/1967 | Germany | 101/415.1 |
| 2031711 | 1/1971 | Germany . | |
| 3731039 | 3/1989 | Germany . | |
| 1300575 | 12/1972 | United Kingdom . | |

*Primary Examiner*—Ren Yan
*Assistant Examiner*—Anthony H. Nguyen
*Attorney, Agent, or Firm*—Herbert L. Lerner; Laurence A. Greenberg

[57] ABSTRACT

Device for fastening a flexible printing plate on a plate cylinder of a rotary printing press includes a tensioning bar disposed axially parallel with the plate cylinder in a cylinder gap formed in the plate cylinder, a clamping bar swivellably fastened to the tensioning bar, a cam shaft supported in respective end walls of the plate cylinder, a first and a second cam pair carried by the cam shaft, first and second spring assemblies, respectively, cooperating with the first and the second cam pairs, the cam shaft being rotatable in one direction for actuating the first cam pair to shift the tensioning bar via cam rollers and against a force of the first spring assemblies into a printing-plate take-up position, and for actuating the second cam pair to open the clamping bar via pins attached thereto against a force of the second spring assemblies so that a trailing end of the printing plate is insertable into the open clamping bar, the cam shaft being rotatable in a direction opposite to the one direction for initially actuating the second spring assemblies to close the clamping bar and for then actuating the first spring assemblies to shift the tensioning bar into a printing-plate tensioning position.

4 Claims, 1 Drawing Sheet

DEVICE FOR FASTENING A FLEXBILE PRINTING PLATE ON A PLATE CYLINDER OF A ROTARY PRINTING PRESS

BACKGROUND OF THE INVENTION

Field of the Invention

The invention relates to a device for fastening a flexible printing plate on a plate cylinder of a rotary printing press.

Published German Patent Document DE 37 31 039 A1 discloses a conventional construction of a device of this general type in the form of a clamping device for flexible printing plates having lever elements which, through the intermediary of pneumatic or hydraulic elements, clamp and tighten a printing plate. In this heretofore known construction, it is necessary for the pneumatic or hydraulic pressure medium to exert a constant pressure during the entire press run in order to ensure a uniform tensioning or tautening of the printing plate.

SUMMARY OF THE INVENTION

It is, accordingly, an object of the invention to provide a device for fastening a flexible printing plate on a plate cylinder of a rotary printing press with which the clamping and tensioning of the printing plate is simplified and which ensures a clamping and tensioning of the printing plate on the plate cylinder during the operation of the printing press and without having to supply any energy.

With the foregoing and other objects in view, there is provided, in accordance with the invention, a device for fastening a flexible printing plate on a plate cylinder of a rotary printing press, comprising a tensioning bar disposed axially parallel with the plate cylinder in a cylinder gap formed in the plate cylinder, a clamping bar swivellably fastened to the tensioning bar, a cam shaft supported in respective end walls of the plate cylinder, a first and a second cam pair carried by the cam shaft, first and second spring means, respectively, cooperating with the first and the second cam pairs, the cam shaft being rotatable in one direction for actuating the first cam pair to shift the tensioning bar via cam rollers and against a force of the first spring means into a printing-plate take-up position, and for actuating the second cam pair to open the clamping bar via pins attached thereto against a force of the second spring means so that a trailing end of the printing plate is insertable into the open clamping bar, the cam shaft being rotatable in a direction opposite to the one direction for initially actuating the second spring means to close the clamping bar and for then actuating the first spring means to shift the tensioning bar into a printing-plate tensioning position.

With the foregoing construction according to the invention, the actuation of only one cam shaft is necessary, and this actuation may be effected either manually or by suitable adjusting means. Furthermore, both the clamping or locking, as well as the tensioning of the flexible printing plate are assured by spring elements during the operation of the printing press, so that a constant clamping and tensioning force is applied without requiring the introduction of any external forces. A further advantage derived from the fastening device according to the invention is that with the tensioning or tightening of the printing plate by spring elements, the latter may be placed in an inclined position for effecting a register correction without requiring any additional adjusting operations.

In accordance with another feature of the invention, the first spring means comprise spring elements disposed between the tensioning bar and the cam shaft.

In accordance with a further feature of the invention, the fastening device includes bearing brackets connected to the tensioning bar, and levers connected to the clamping bar, the second spring means comprising spring and lever assembly units disposed between the bearing brackets of the tensioning bar and the levers of the clamping bar.

In accordance with a concomitant combination of features, the fastening device includes bearing brackets connected to the tensioning bar, and levers connected to the clamping bar, the first spring means comprising spring elements disposed between the tensioning bar and the cam shaft, and the second spring means comprising spring and lever assembly units disposed between the bearing brackets of the tensioning bar and the levers of the clamping bar.

Other features which are considered as characteristic for the invention are set forth in the appended claims.

Although the invention is illustrated and described herein as embodied in a device for fastening a flexible printing plate on a plate cylinder of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
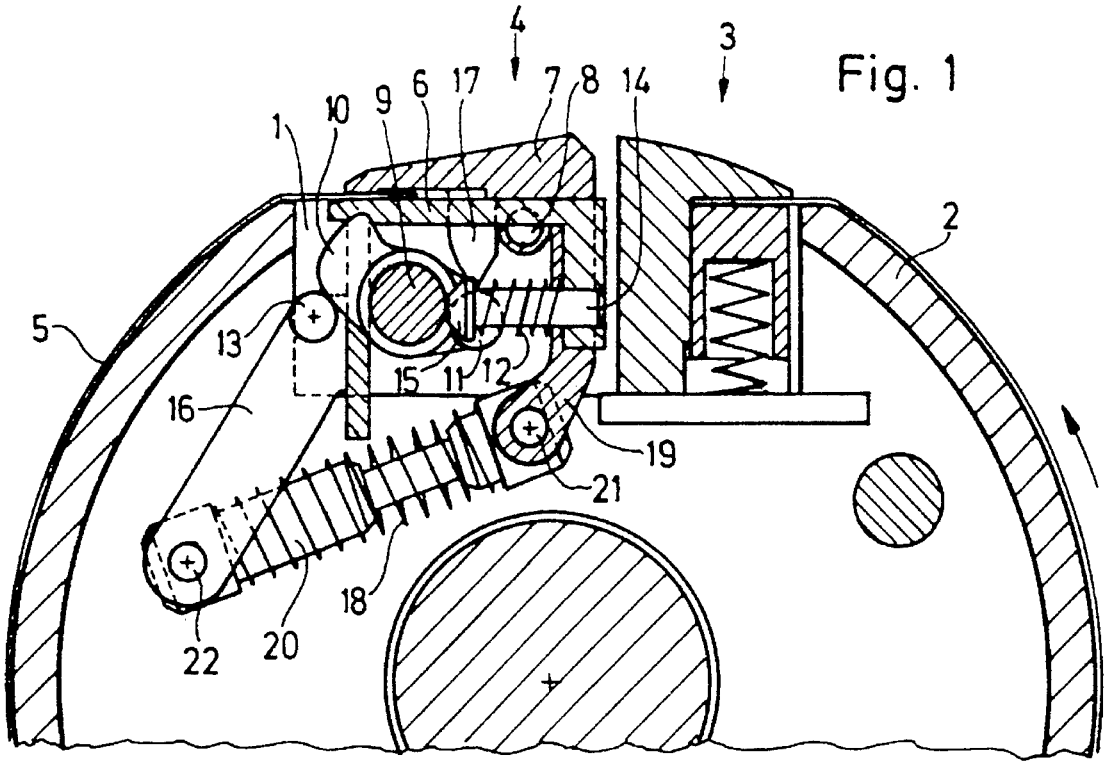
FIG. 1 is a fragmentary cross-sectional view of a plate cylinder of an otherwise non-illustrated rotary printing press provided with the fastening device according to the invention, by which a printing plate has been tightened and clamped or locked on the plate cylinder.

Referring now to the drawing and, first, particularly to FIG. 1 thereof, there is shown therein a clamping device 3 mounted in a gap or groove 1 of a plate cylinder 2 for clamping a leading end of a flexible printing plate 5, and a device 4 for fastening the printing plate 5 on the plate cylinder 2. The device 4 is formed of a tightening or tensioning bar 6 disposed axially parallel to the plate cylinder 2 in the gap 1, and a clamping or locking bar 7 fastened to the tensioning bar 6. The tensioning bar 6 is displaceably mounted in the gap 1 of the plate cylinder 2 and carries at both ends thereof respective pins 8 whereon the clamping or locking bar 7 is swivellably mounted.

A cam shaft 9, which is journalled in respective end walls of the plate cylinder 2, is provided for actuating the tensioning bar 6 and the clamping bar 7. The cam shaft 9 carries two cam pairs 10 and 11, the cam pair 10 serving to displace the tensioning bar 6 through the intermediary of cam rollers 13 against the force of spring elements 12. In this regard, the spring elements 12 are provided on bolts 14 which are mounted in the tensioning bar 6 so as to be longitudinally displaceable, and so that they are braced by the respective heads 15 thereof against the cam shaft 9. The cam rollers 13 are fastened to bearing brackets 16 which are also connected to the tensioning bar 6.

Figure 2:
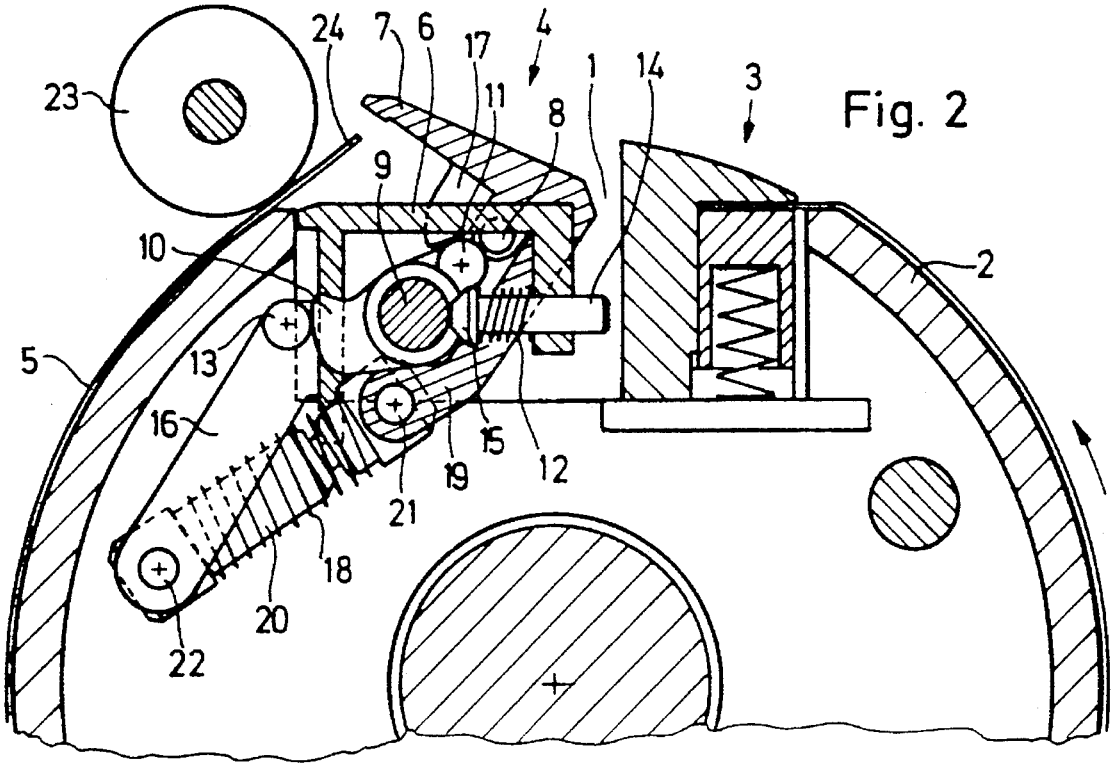
FIG. 2 is a view like that of FIG. 1 showing the fastening device in another operating mode thereof wherein the printing plate has been disposed without tensioning on the plate cylinder and an end thereof inserted into the fastening device but not yet clamped or locked therein.

When the cam shaft 9 is rotated counter-clockwise, the other cam pair 11 presses a pin 17 fastened to the clamping bar 7 upwardly so that the clamping bar 7 opens and assumes the position thereof shown in FIG. 2. The opening of the clamping bar 7 is also effected against the force of springs 18, which are actuated by levers 19 which, in turn, are fastened to the clamping bar 7. The springs 18 are actuatable by means of a plunger or push rod 20 which is fastened at one end thereof via pins 21 to the levers 19, and at the other end thereof via pins 22 to the bearing brackets 16.

In FIG. 1, the printing plate 5 is shown clamped between the tensioning bar 6 and the clamping bar 7, and the tensioning bar 6 with the clamping bar 7 are shifted towards the right-hand side of FIG. 1 due to the force of the spring element 12, so that the printing plate is tightened or tautened on the outer cylindrical surface of the plate cylinder 2. In this regard, the cam shaft 9 is rotated clockwise into the starting position thereof as shown. If the cam shaft 9 is then rotated counter-clockwise, the tensioning bar 6 with the clamping bar 7 are then initially displaced via the cam roller 13 to the left-hand side of the figure and the printing plate 5 is accordingly loosened and relieved of tension. The clamping bar 7 is then opened by means of the other cam pair 11 and the pin 17, as illustrated in FIG. 2. The tensioning bar 6 is thereby located in the left-hand starting position thereof. If a new printing plate 5 is then placed on the plate cylinder 2, it is initially clamped at the leading edge thereof by the clamping device 3 and, by rotating or turning the plate cylinder 2 counter-clockwise, it is pressed by rollers 23 fixedly mounted on non-illustrated side frames of the press onto the outer cylindrical surface of the plate cylinder 2. When the plate cylinder 2 has reached the position thereof shown in FIG. 2 after about one rotation, the rollers 23 press the the trailing plate end 24 into the illustrated position thereof so that the widely-opened clamping bar 7 can be closed and the plate end 24 clamped, as shown in FIG. 1. Thereafter, by further rotating the cam shaft 9, the tensioning or tightening of the printing plate 5 is effected, due to the displacement of the tensioning bar 6 with the clamping bar 7 towards the right-hand side of the figure.

We claim:

1. A device for fastening a flexible printing plate on a plate cylinder of a rotary printing press, wherein the plate cylinder has a cylinder gap formed therein axially parallel and the plate cylinder includes two end walls at opposite ends thereof, comprising a tensioning bar disposed in the cylinder gap formed in the plate cylinder, a clamping bar swivellably fastened to said tensioning bar, pins fastened to said clamping bar, a cam shaft supported in respective end walls of the plate cylinder, a first and a second cam pair carried by said cam shaft, bearing brackets connected to said tensioning bar, cam rollers fixed to said bearing brackets, first and second spring means cooperating with said first and said second cam pairs, said cam shaft being rotatable in one direction for actuating said first cam pair to shift said tensioning bar via said cam rollers and against a force of said first spring means into a printing-plate take-up position, and for actuating said second cam pair to open said clamping bar via said pins attached thereto against a force of said second spring means so that a trailing end of the printing plate is insertable into the open clamping bar, said cam shaft being rotatable in a direction opposite to said one direction for initially actuating said second spring means to close said clamping bar and for then actuating said first spring means to shift the tensioning bar into a printing-plate tensioning position.

2. Fastening device according to claim 1, wherein said first spring means comprise spring elements disposed between said tensioning bar and said cam shaft.

3. Fastening device according to claim 1, including levers connected to said clamping bar, and wherein said second spring means comprise spring and lever assembly units disposed between said bearing brackets of said tensioning bar and said levers of said clamping bar.

4. Fastening device according to claim 1, including levers connected to said clamping bar, and wherein said first spring means comprise spring elements disposed between said tensioning bar and said cam shaft, and said second spring means comprise spring and lever assembly units disposed between said bearing brackets of said tensioning bar and said levers of said clamping bar.

* * * * *